US009347159B2

(12) United States Patent
Klaska et al.

(10) Patent No.: US 9,347,159 B2
(45) Date of Patent: May 24, 2016

(54) METHOD OF PRODUCING A NONWOVEN TEXTILE COMPRISING A BARRIER AND AN ANTISTATIC TREATMENT

(75) Inventors: Frantisek Klaska, Slavkov U Brna (CZ); Zdenek Mecl, Novy Saldorf-Sedlesovice (CZ); Katerina Tvaruzkova, Prosimerice (CZ); Pavlina Kasparkova, Znojmo (CZ)

(73) Assignee: Pegas Nonwovens s.r.o., Znojmo (CZ)

( * ) Notice: Subject to any disclaimer, the term of this patent is extended or adjusted under 35 U.S.C. 154(b) by 758 days.

(21) Appl. No.: 13/642,659

(22) PCT Filed: Apr. 18, 2011

(86) PCT No.: PCT/CZ2011/000037
§ 371 (c)(1),
(2), (4) Date: Jan. 21, 2013

(87) PCT Pub. No.: WO2011/131156
PCT Pub. Date: Oct. 27, 2011

(65) Prior Publication Data

US 2013/0115843 A1 May 9, 2013

(30) Foreign Application Priority Data

Apr. 23, 2010 (CZ) ..... 2010-312

(51) Int. Cl.

| | |
|---|---|
| ***B32B 27/12*** | (2006.01) |
| ***B32B 27/18*** | (2006.01) |
| ***B32B 27/32*** | (2006.01) |
| ***D01F 1/02*** | (2006.01) |
| ***D01F 1/07*** | (2006.01) |
| ***D01F 1/09*** | (2006.01) |
| ***D01F 6/06*** | (2006.01) |
| ***D04H 18/00*** | (2012.01) |
| ***D01F 1/10*** | (2006.01) |
| ***D01F 6/04*** | (2006.01) |
| ***D01F 6/46*** | (2006.01) |
| ***D04H 3/007*** | (2012.01) |
| ***D04H 3/02*** | (2006.01) |
| ***D04H 3/16*** | (2006.01) |
| ***D06M 13/188*** | (2006.01) |
| ***D06M 13/256*** | (2006.01) |
| ***D06M 13/262*** | (2006.01) |
| ***D06M 13/292*** | (2006.01) |
| ***D06M 13/325*** | (2006.01) |

(Continued)

(52) U.S. Cl.

CPC ..... *D04H 18/00* (2013.01); *D01F 1/10* (2013.01); *D01F 1/106* (2013.01); *D01F 6/04* (2013.01); *D01F 6/46* (2013.01); *D04H 3/005* (2013.01); *D04H 3/007* (2013.01); *D04H 3/02* (2013.01); *D04H 3/16* (2013.01); *D06M 13/188* (2013.01); *D06M 13/256* (2013.01); *D06M 13/262* (2013.01); *D06M 13/292* (2013.01); *D06M 13/325* (2013.01); *D06M 13/342* (2013.01); *D06M 13/46* (2013.01); *D06M 2101/20* (2013.01); *D06M 2200/40* (2013.01); *Y10T 442/671* (2015.04)

(58) Field of Classification Search

CPC ..... B32B 5/022; B32B 27/12; B32B 27/18; B32B 27/32; B32B 2260/021; B32B 2260/023; D01F 1/02; D01F 1/07; D01F 1/09; D01F 1/10; D01F 1/106; D01F 6/04; D01F 6/06; D01F 6/46; D04H 3/005; D04H 3/007; D06M 13/188; D06M 13/256; D06M 13/262; D06M 13/292; D06M 13/325; D06M 13/342; D06M 13/46; D06M 2200/30; D06M 2200/40; D06M 2101/20

USPC ..... 264/103, 129, 134, 136, 137, 171.1, 264/210.6, 211, 211.14, 211.15; 156/148, 156/167, 181

See application file for complete search history.

(56) References Cited

U.S. PATENT DOCUMENTS 3,847,676 A * 11/1974 Palmer et al. ..... 264/115
3,849,241 A 11/1974 Butin et al.

(Continued)

FOREIGN PATENT DOCUMENTS

EP 0738800 A2 10/1996
WO 2009077889 A1 6/2009

OTHER PUBLICATIONS

International Search Report issued in counterpart PCT Application No. PCT/CZ2011/000037, mailed on Oct. 20, 2011 (3 pages).

*Primary Examiner* — Leo B Tentoni
(74) *Attorney, Agent, or Firm* — Wood, Herron & Evans, LLP

(57) ABSTRACT

A method of producing nonwoven textile by a spunmelt process of a polymer, the basis of which is at least one polyolefin, comprising a barrier and antistatic treatment, especially for protective garments for industry and health care. A polyolefin polymer which is suitable for forming fibers is mixed with a first additive capable of modifying a surface property and capable of migration through the polymer, then the mixture is used for producing at least one layer of the nonwoven textile by a spun-melt process, and prior to the termination of the migration of the first additive and to the stabilizing of the final barrier properties on the surface of the fibers a second additive is applied to the layer, the second additive being capable of modifying the antistatic property of the material, and then the nonwoven textile is exposed to a temperature and relative humidity conditions for a time period such that the first additive migrates towards the surface and the second additive undergoes changes on said surface.

20 Claims, 1 Drawing Sheet

(51) Int. Cl.

| | |
|---|---|
| ***D06M 13/342*** | (2006.01) |
| ***D06M 13/46*** | (2006.01) |
| ***D04H 3/005*** | (2012.01) |
| *D06M 101/20* | (2006.01) |

(56) References Cited

U.S. PATENT DOCUMENTS

| | | | | |
|---|---|---|---|---|
| 4,041,203 | A | 8/1977 | Brock et al. | |
| 4,115,605 | A | 9/1978 | Hultman et al. | |
| 4,115,608 | A | 9/1978 | Glass | |
| 5,145,727 | A | 9/1992 | Potts et al. | |
| 5,151,321 | A | 9/1992 | Reeves et al. | |
| 5,178,932 | A | 1/1993 | Perkins et al. | |
| 6,043,168 | A * | 3/2000 | Colman et al. | 442/118 |
| 6,235,914 | B1 * | 5/2001 | Steiger et al. | 554/114 |
| 2004/0116018 | A1 * | 6/2004 | Fenwick et al. | 442/164 |
| 2004/0209541 | A1 | 10/2004 | Bonneh | |
| 2009/0203276 | A1 | 8/2009 | Kutsenko et al. | |
| 2009/0209541 | A1 | 8/2009 | Jain et al. | |
| 2012/0077886 | A1 * | 3/2012 | Scholz et al. | 514/772.4 |

* cited by examiner

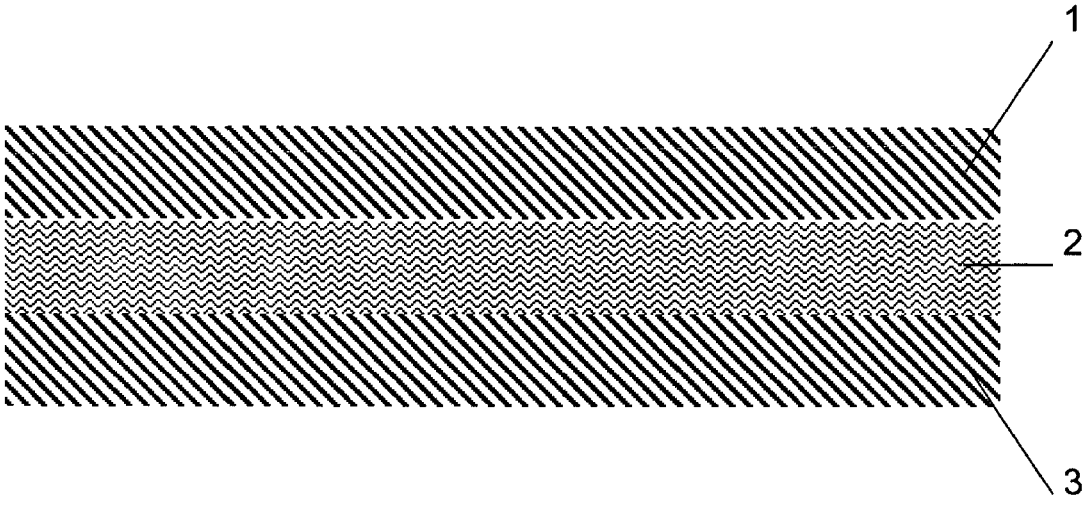
1
2
3

METHOD OF PRODUCING A NONWOVEN TEXTILE COMPRISING A BARRIER AND AN ANTISTATIC TREATMENT

FIELD OF THE INVENTION

The invention relates to a method of producing a nonwoven textile manufactured by a spunmelt process of a polymer, the basis of which is at least one polyolefin, the method comprising an anti-penetration and antistatic treatment, especially for protective garments in industry as well as in health care.

PRIOR ART

For the manufacture of protective garments for a wide range of applications in industry, agriculture and healthcare, the construction technology used in the majority of cases for these products is a nonwoven textile manufactured using spunmelt technology from continuous polyolefin filaments forming covering layers of the product, so called spunbond (S) nonwoven textiles (NT) combined with internal layers from meltblown (M) nonwoven textiles consisting of microfibres. Generally these laminates are identified according to the number of individual layers, e.g. SMS, SMMS, SSMMS etc.

Strengthening of nonwoven textile web generally used for medical products is usually done using a thermal embossing calender, where an embossing pattern with a bonding area of 10-25% of the total area of the calender roller is used.

These nonwoven textiles are produced from continuous fibres of synthetic polymers, in the majority of cases e.g. a polypropylene (hereafter PP) or a polyethylene (hereafter PE).

Also known are so called multicomponent fibres, wherein a fibre is produced of more production components—these may be various polymers (e.g. PP and PE), or blends, where the basis is the same polymer and the components differ for example in the concentration of additives. Different types of bicomponent fibres are known the types differing from each other in the cross sectional configuration of the two components (e.g. side/side, core/sheath, eccentric fibres, etc.). The weight ratio of the components can range from a ratio of 10:90 to a ratio of 90:10.

This type of material itself has significant barrier properties against the penetration of water and polar solutions. To achieve antistatic properties and resistance against the penetration of liquids with a lower surface tension, other treatments are necessary. Unfortunately, treatments for barrier properties and treatments for antistatic properties typically contradictory effects. For example, the presence of an antistatic agent on a nonwoven fabric negatively influences barrier properties of the finished web, as measured by hydrostatic head testing. There are several known ways how to solve this problem.

For example U.S. Pat. No. 4,041,203 submitted in 1977 by Brock and Meitner describes the SMS type structure and its antistatic treatment using an antistatic agent with a high content of quaternary ammonium salts in combination with a high molecular cationic fluorocarbon in a water emulsion. Other appropriate agents are described for example in U.S. Pat. No. 4,115,605 from 1978.

Other meaningful improvements are described in U.S. Pat. No. 5,151,321 from 1992 submitted by Kimberly-Clark, which brings new combinations of agents enabling a variable combination of treatments. The textile is soaked in a bath with the agent, the application of which is controlled by a pressure roller to the level of a wet pick up of approximately 100% and subsequently it is dried in a dryer. The entire textile production and treatment process can also be carried out in a continual configuration, a discontinuous process is more usual though. Furthermore, the process is very sensitive to the exact configuration of production conditions—the pH of the solutions, the temperature and the duration of drying—and it is also very energy intensive. The disadvantage of this described production process is the impregnation—wetting procedure for the application of the required amount of treatment with a large wet extra weight. The large amount of the applied water bath means that there are large demands on drying. The liquid form of the fluorocarbon agent deposit requires further supplementary heat activation after drying in order to achieve the required effects, the process is therefore time consuming and demanding on energy. Continuous production equipment can therefore function at a limited speed or requires a huge heated activation area, which ensures the effect of the activation conditions on a treated nonwoven for a time in the range of tens of seconds. An off-line production method, where the production of a nonwoven textile and its treatment with these agents is separated is disadvantageous due to a number of technological and economic aspects.

WO 2009/077889 submitted by Kimberly-Clark describes a different approach. Instead of preparing one mixture of active agents, a dual treatment is employed: First, a nonwoven web is formed from thermoplastic mixture of an antistatic agent and a thermoplastic polymer. Then, a high energy treatment is applied to a surface of the nonwoven web and a fluorinated agent is grafted to the surface of the spunbond web utilizing monomer deposition process. The monomer deposition process can generally include evaporating a liquid fluorinated agent in a vacuum chamber, followed by depositing the fluorinated agent gas on a surface of the spunbond web, and exposing the surface to radiation. The method is very complicated, as it requires special equipment and it is also energy consuming.

The aim of the invention is to provide a method of producing a nonwoven textile having barrier and antistatic properties, wherein the method should eliminate the drawbacks of the known solutions and it should enable a continuous production of such a nonwoven textile.

SUMMARY OF THE INVENTION

The substance of the invention consists in that a polyolefin polymer which is suitable for forming fibres is mixed with a first additive capable of modifying a surface property and comprising a functional component capable of migration through the polymer, then the mixture is used for producing at least one layer of a nonwoven textile by a spunmelt process, and prior to the termination of the migration of the first additive and to the stabilizing of the final barrier properties on the surface of the fibers a second additive is applied to the layer, the second additive being capable of modifying the antistatic property of the material, and then the nonwoven textile is exposed to a temperature and relative humidity conditions for a time period such that the first additive migrates towards the surface and the second additive undergoes changes on said surface.

The substance of the invention consists in that the method of producing a nonwoven textile comprises the following steps:

i) providing a production mix of polymer, the basis of which is a polyolefin polymer suitable for forming fibres;

ii) providing a first additive capable of modifying a surface property and capable of migration through the polymer;

iii) mixing said polymers and said first additive;

iv) forming fibres, optionally bi-component fibers, from said mixture, and a nonwoven textile from said fibres;

v) providing a second additive capable modifying a surface property and capable of adhering to the surface of said fibres;

vi) applying said second additive to the surface of the fibres of said nonwoven textile;

vii) establishing temperature and relative humidity conditions for a time period such that said second additive undergoes changes on said surface and said first additive migrates towards said surface;

wherein said changes of the second additive take place at least partly prior to a stabilization of the surface property caused by the first additive.

It is meaningful for the final properties of the nonwoven textile produced by the method according to the invention, that following the above mentioned steps a conditioning of the nonwoven textile takes place under a temperature of at least 10° C., preferably at least 20° C., and a relative humidity of at least 20%, preferably 60%.

It is also meaningful for the method according to the invention that the second additive is applied in the form of a solution, preferably in the form of a water solution. the first additive is selected from a group consisting of compounds comprising fluorocarbon, wax and silicon groups and the second additive is selected from a group comprising carboxylic groups or their salts, sulphate groups, alkylsulphates or alkylglykoethersulphates, sulphonates, alkylsulphonates, alkylbenzen sulphonates, alkylphosphates, alkylphenylphosphates, alkylaminsalts, quaternary ammonium salts, alkylpyridine salts or alkylaminocarboxylic acids.

As to the starting materials, it is meaningful that the polymer suitable for forming fibers is a mixture of thermoplastic polymers, comprising at least 70% by weight of a thermoplastic polyolefin, wherein the polyolefin is e.g. a polymer or a co-polymer of a polypropylene or a polyethylene.

It is meaningful for the method that the migration of the first additive towards the surface of the fibers and the changes of the second additive on the surface of the fibers take place under a temperature of at least 10° C. and a relative humidity at least 25% for at least 5 hours.

An advantage of the invention is the combination of the additive, which enhances the barrier properties of the textile, and the liquid surfactant which causes an antistatic effect. Such disposition makes it possible to control efficiently the final properties, such that a material having high level of barrier and antistatic properties or—for less exacting applications—a material having high level of antistatic properties in combination with lower level of barrier properties, or a material having a high level of barrier properties and a low or zero level of antistatic properties.

The wet pick necessary for the method was within the range of 5-25%, which is a fraction of the amount necessary for known methods and, consequently, it is possible to use various methods of application—kiss roller (kiss roll), spraying etc. and it is possible to use the method under low temperatures and under high production speeds, such that the method is suitable for a continuous process of production and treatment of a textile.

The method according to the invention eliminates any necessity to thermally activate the material such that not only the production speed is increased but also energy may be saved.

To a great extent the invention eliminates disadvantages of the known solutions, especially the necessity to execute the treatment of the nonwoven textile discontinuously, the necessity to expose the treated textile to thermal energy (which is necessary for the activation of the applied treatment), while the invention allows to control the level of the antistatic treatment and of the barrier treatment (the alcohol repellency) easily and independently from each other. The invention relates to a continuous as well to a discontinuous production method, if the delay between the production of fibers comprising the first additive and the application of the second additive is less than 12 hours.

Using the method according to the invention for a continuous process executed at high speeds corresponding to the standard production speeds for nonwoven textiles it is possible to produce a material which has combination of antistatic properties (in accordance with the international textile test EN 1149) and an alcohol repellency (in accordance with the international textile test WSP 80.8-2005), while the level of water column does not drop below 20% when compared with a material of the same type, but not treated.

The substance of the invention is also the use of the nonwoven textile produced according to the invention as a barrier material for protective garments, medical garments, surgical and medical drapes, surgical masks, packaging material, sterile wrappings, pads, parts of filters and hygiene products.

EXEMPLIFYING EMBODIMENTS OF THE INVENTION

In the following section of the description abbreviations will be used, which characterise various designs of a nonwoven textile and which are commonly used in the branch:

The term "nonwoven textiles" refers to a sheet of fibres comprising continuous filaments or chopped yarns of synthetic polymers that have been formed into a web, wherein SB—refers to a nonwoven textile produced using spun bond technology;

MB—refers to a nonwoven textile produced using melt blown technology;

two or more of such webs may be combined to form a multi-layer nonwoven textile laminate, wherein the following abbreviations shall be used:

S—nonwoven textile produced using spunbond technology;

M—nonwoven textile produced using spunmelt technology;

so for example:

SMS—is a multi-layer nonwoven textile, wherein the two outer or external layers are produced using spunbond technology and the middle layer is produced using melt blowing technology, an embodiment of such a textile is shown in FIG. 1;

SSMMS—a multi-layer nonwoven textile, which contains two middle layers produced using melt blown technology, adjoined from one side by two external layers produced using spunbond technology and from the other side by a single external layer produced using spunbond technology;

BICO—a bicomponent nonwoven textile.

GENERAL DESCRIPTION OF THE METHOD ACCORDING TO THE INVENTION

An SB nonwoven textile is produced by the method according to the invention using continuous filaments, for example continuous polymer filaments, containing polyolefinic polymers such as polyethylene or polypropylene (often marked as homopolymers), or polypropylene or polyethylene copolymer. The filaments are placed on a moving belt in a random distribution at a required basis weight. The diameter of the filaments is typically 10-50 μm, while the kilogram output of a unit of production equipment per 1 m width of the product is usually in the range of 100-250 kg/h/m. The basis weight of such layers may usually range from a 1 g/m$^2$ to 30 g/m$^2$.

Further, in the standard well known SB type nonwoven textile production process, polymer granules are melted and subsequently extruded through a spinning nozzle to create several thin filaments, wherein various process additives (colours, UV stabilizers, etc.) may be added to the melt. To increase the effect of repellency against water and/or chemicals a certain amount of suitable, commercially available additives is added to the melt, such as additives based on fluorocarbon and/or wax and/or silicon additives, which will be referred to as first additives hereafter. Such additives are disclosed, for example, in the US Patent Application No. 2009/0203276 published on Aug. 13, 2009. The functional parts of such additives may have the ability of migrating through the mass of the polymer towards the surface of the fibres. This diffusion of the additives through the polymer is typically a very slow process, which starts immediately after the production, but can take up to several days to be finished. It is considered to be finished, when the concentration of the additive on the surface of the fiber is not changing significantly any more, such as may be established by monitoring surface properties such as alcohol repellency or surface resistance. The amount of this first additive in the mass depends on the type of the additive, but a skilled person will readily determine the optimum level, which is typically between 0.5% and 10%. According to the invention, the first additive is mixed homogeneously with the remaining polymer. Alternatively, the additive may be inhomogeneously distributed within the polymer across the fibre cross-section directly during formation of the fibres.

Optionally, the fibres may be formed as bicomponent fibres, such as well known in the art, such as, for example, in a so called "sheath-core" or "side-side" arrangement. An additive may be added to either or both of the components, in the latter case it may be the same or a different compound, and it may be added at the same or different concentration levels.

It is also possible to apply the method according to the invention to the known meltblowing process of production of nonwoven textiles. A standard meltblown has been disclosed, for example, in U.S. Pat. No. 3,849,241, a modern version "biax" has been disclosed, for example, in US Patent Application No. 2004/0209541 published on Oct. 21, 2004. Typically, the meltblown process of production of nonwoven textiles produces fibres having a diameter of between 0.5 and 20 μm, sometimes also referred to as microfibers. As described in respect of the spunbonding process, additives may be added to the mass.

It should be noted, that a distinction between SB and MB processes and webs is not always obvious, as—for example—lower diameter and higher attenuation spunbond fibers may be almost indistinguishable from a larger diameter, lower attenuation meltblown fibers. Henceforth, for the present context, reference is made to particular diameters of the fibres, and typically, but not necessarily, smaller diameter fibres are produced by meltblowing, and larger diameter fibres by spunbonding.

A multilayer nonwoven textile is usually produced on a continuous production line, wherein a SB web is produced in a first production step and, subsequently, a MB layer is produced in a continuously integrated production unit, where it is also possible to add appropriate additives into the melt for either or both of the fiber types.

Individual technological types of layer production can be arbitrarily combined in various sequences and in various amounts. The starting polymer, the composition of the additives and of other substances may be the same of all of the particular layers or may differ for various layers. At the present time there exist production lines with up to six consecutively placed production units which may be used for a process of production of a nonwoven textile. Usually SB type production units are located at the beginning and at the end of the production line and MB type production units are located in the middle. Production units arranged in such a way are identified as SMS, SMMS, SSMMS, SSMMMS, etc.

The flat fibrous forms produced in such a way typically go through a bonding unit composed of bonding calender rollers heated to the required temperatures and adjusted to the required pressure. One of the pair of the bonding rollers has a bonding embossing pattern, formed from a series of elevated bonding surfaces-bonding areas. Through an appropriate combination of temperature and pressure of the calendering rollers a laminate composed of the individual layers is created joined together in the bonding areas.

In the following production step a liquid surfactant additive (referred to as second additive hereafter) is applied, such as by using a kiss roll or by spraying, thereby applying a required amount of surfactant with an affinity for PP polymers to the surface of the NT. The amount of added surfactant is within the range of 5% to 25%, on a wet basis and between 0.05% and 5% surfactant on a dry basis, relative to the weight of the NT. The level of the required properties of the material may be controlled by controlling the amount of the additive applied. The additive may be applied on both sides or on one of them only.

A part of the deposition unit is a drying unit, where excess water is evaporated and active surfactant components are fixed to the surface of the fibres. The additive undergoes a reaction, e.g. a chemical reaction or a crystallisation, and then it is bonded to the surface such as by covalent (cross-linking), ionic, Van der Waals, hydrogen bonds or by adhesive forces. Preferred additives are antistatic agents comprising carboxylic groups or their salts, sulphate groups, alkylsulphates or alkylglykoethersulphates, sulphonates, alkylsulphonates, alkylbenzen sulphonates, alkylphosphates, alkylphenylphosphates, alkylaminsalts, quaternary ammonium salts, alkylpyridin salts or alkylaminokarboxyl acids.

After the production, the material is conditioned such as by being stored in a warehouse with controlled climatic conditions for a certain time. Under such conditions, satisfactory changes of the antistatic additive are achieved and its fixation to the fibres realised, meaning that the surface conductivity of the material is increased, without lowering its repellency to water, water solutions and isopropyl alcohol significantly. A man skilled in the art will readily realise that the required time depends on the climatic conditions. In order to achieve permanent and satisfactory properties of the material, the time should be at least 10 hrs, preferably at least 72 hrs. An upper limit is not essential for the present invention, but is typically determined by logistic flexibility. The temperature should not be below 10° C., preferably not below 20° C., and typically should not exceed 50° C., preferably 30° C. The relative humidity should be at least 25%, and is preferably around 60%. A man skilled in the art will readily realise that constant conditions are preferred, but certain deviation of both temperature and relative humidity may be acceptable.

The present invention provides NT materials, which exhibit a particular combination of properties, which make them particularly useful in the application as barrier materials.

In particular the webs should exhibit good alcohol repellency. This property can be determined by the so-called drop test as described in the EDANA test method WSP 80.8-2005. Preferably, the materials exhibit a degree of at least 3, preferably at least 8.

Further, the materials exhibit a high degree of water repellency, as is determined by the height (in mm) of a water column according to EDANA WSP 80.6-2005. This value should preferably be at least about 150 mm, preferably at least 500 mm. As the water column values are also dependent on web properties such as fibre diameter and density, it is preferred, that a NT as produced by the process according to the present invention preferably has a water column which is reduced by less 50%, more preferably less than 20% compared to a material exhibiting the same web properties but without the addition of the two additives and the respective conditioning.

Also, the materials should exhibit a surface resistance value, as determined by EN1149-1, of less than 5×10e12 $\Omega/m^2$, preferably of less than 2.5×10e9 $\Omega/m^2$.

The advantages of adding the first additive into the mass of the fibres, wherein the first additive increases the barrier properties of the material, and of shortly afterwards adding the second additive on the surface of the fibres, wherein the second additive provides antistatic properties, are as follows:

1) The first additive, i.e. its functional component added to the polymer, gradually migrates through the fibre material, meaning that at the time when the wet treatment with the surfactant is applied the final barrier properties are not achieved and the wet chemical treatment solution exhibits better adhesion to the nonwoven textile fibres.
2) Compared to the conventional application of the functional components using the wet method, less water is used and so savings of water and also of energy used for drying of the material are achieved.
3) Including the first additive or its functional component into the fibres during their manufacture and reducing the amount of wet chemical treatment by the second additive makes it possible to operate the production equipment at speeds equivalent to NT production speeds.
4) By separating the application of both functional components it is possible to control the antistatic level and the repellency to alcohol independently of one another.
5) Incorporating the functional component into the material of the bicomponent fibres in various concentrations in individual parts of the composition and subsequently applying the antistatic agent makes it possible to control the level of individual properties, while achieving savings on materials.

Examples of Nonwoven Textile Designs According to the Invention:

Examples of Materials Used:

Examples of additives which may be used for achieving improved barrier properties, especially high repellency to water and to alcohol, i.e. which may be used as first additive:

Additive A HydRepel™ A 202, Goulston Technologies; in PP masterbatch with a melt flow index of 35 MFI (it is possible to use PP with a melt flow index of 15-60 MFI)

Additive B HydRepel™ A 201, Goulston Technologies; in PP masterbatch with a melt flow index of 35 MFI (it is possible to use PP with a melt flow index of 15-60 MFI)

Additive C HydRepel™ A 202, Goulston Technologies; in PP masterbatch with a melt flow index of 500 MFI (it is possible to use PP with a melt flow index of 300-1000 MFI)

Additive D HydRepel™ A 201, Goulston Technologies; in PP masterbatch with a melt flow index of 500 MFI (it is possible to use PP with a melt flow index of 300-1000 MFI)

Additive E HydRepel™ A 204, Goulston Technologies; in PP masterbatch with a melt flow index of 35 MFI (it is possible to use PP with a melt flow index of 15-60 MFI)

Additive F HydRepel™ A 204, Goulston Technologies; in PP masterbatch with a melt flow index of 500 MFI (it is possible to use PP with a melt flow index of 300-1000 MFI)

Examples of means for wet chemical treatment which may be used for the achievement of antistatic material properties, i.e. which may be used as second additive:

Surfactant 1 Water solution Lurol ASY, Goulston Technologies; at a concentration of 5%

Surfactant 2 Water solution Statexan, Noveon; at a concentration of 5%

Examples of production of nonwoven textiles according to the invention:

EXAMPLE 1

A spunmelt type nonwoven textile composed of three functional filament layers with a total basis weight of 34 gsm, wherein the first functional layer 1 consists of continuous filaments with a diameter of 10-50 μm composed of a production mix of SB type polypropylene with a melt flow index of 10-30 MFI (e.g. Mosten NB 425) and the additive A; the second functional layer 2 consists of micro-filaments with a diameter of 0.5-15 μm composed of a production mix of MB type polypropylene with a melt flow index of 600-1500 MFI (e.g. Moplen HL 508) and the additive C; the third functional layer 3 consists of filaments with a diameter of 10-50 μm composed of a production mix of SB type polypropylene with a melt flow index of 10-30 MFI (e.g. Mosten NB 425) and the additive A; produced at a production rate of 408 kg/m/hour, bonded using a raster calender; impregnated in-line with the Surfactant 1 using an inserted application kiss roller (kiss-roll) and dried on a drum dryer. The delay between the formation of the fibres and the application of the surfactant is less than 1 minute. Subsequently, the material was stored in a conditioning warehouse for a period of 5 days, where the temperature remained in the range 10-30° C. and air humidity did not fall below 60%.

EXAMPLE 2

A spunmelt type nonwoven textile composed of three functional filament layers with a total basis weight of 45 gsm, wherein the first functional layer 1 consists of continuous filaments with a diameter of 10-50 μm composed of a production mix of SB type polypropylene with a melt flow index of 10-30 MFI (e.g. Mosten NB 425), blue colour (e.g. masterbatch CC10035377BG) and the additive A; the second functional layer 2 consists of micro-filaments with a diameter of 0.5-15 μm composed of a production mix of MB type polypropylene with a melt flow index of 600-1500 MFI (e.g. Moplen HL 508) and the additive C; the third functional layer 3 consists of filaments with a diameter of 10-50 μm composed of a production mix of SB type polypropylene with a melt flow index of 10-30 MFI (e.g. Mosten NB 425) and the additive A; produced at a production rate of 408 kg/m/hour, bonded using a raster calender; impregnated in-line with the Surfactant 2 using an inserted application kiss roller (kiss-roll) and dried on a drum dryer. The delay between the formation of the fibres and the application of the surfactant is less than 1 minute. Subsequently, the material was stored in a conditioning warehouse for a period of 5 days, where the temperature remained in the range 10-30° C. and air humidity did not fall below 60%.

EXAMPLE 3

A spunmelt type nonwoven textile composed of three functional filament layers with a total basis weight of 60 gsm, wherein the first functional layer 1 consists of continuous filaments with a diameter of 10-50 μm composed of a production mix of SB type polypropylene with a melt flow index of 10-30 MFI (e.g. Mosten NB 425), green colour (e.g. masterbatch Remafin Green PP63076210-ZT) and a lower concentration of the additive B; the second functional layer 2 consists of micro-filaments with a diameter of 0.5-15 μm composed of a production mix of MB type polypropylene with a melt flow index of 600-1500 MFI (e.g. Moplen HL 508), green colour (e.g. masterbatch Remafin Green PP63076209-ZT) and the additive D; the third functional layer 3 consists of filaments with a diameter of 10-50 μm composed of a production mix of SB type polypropylene with a melt flow index of 10-30 MFI (e.g. Mosten NB 425), green colour (e.g. masterbatch Remafin Green PP63076210-ZT) and a lower concentration of the additive B; produced at a production rate of 408 kg/m/hour, bonded using a raster calender; impregnated in-line with the Surfactant 2 using an inserted application kiss roller (kiss-roll) and dried on a drum dryer. The delay between the formation of the fibres and the application of the surfactant is less than 1 minute. Subsequently, the material was stored in a conditioning warehouse for a period of 5 days, where the temperature remained in the range 10-30° C. and air humidity did not fall below 60%.

EXAMPLE 4

A spunmelt type nonwoven textile composed of three functional filament layers with a total basis weight of 34 gsm, wherein the first functional layer 1 is composed of continuous bicomponent filaments of the core/sheath type with a diameter of 10-50 μm. The weight ratio core:sheath is found on a wide scale (e.g. 50:50). (1.1) The sheath is composed of a production mix of SB type polypropylene with a melt flow index of 10-30 MFI (e.g. Mosten NB 425), green colour (e.g. masterbatch Remafin Green PP63076210-ZT) and the additive B; (1.2) the core is composed of a production mix of SB type polypropylene with a melt flow index of 10-30 MFI (e.g. Mosten NB 425), green colour (e.g. masterbatch Remafin Green PP63076210-ZT) and a lower concentration of the additive B; the second functional layer 2 is composed of micro-filaments with a diameter of 0.5-15 μm composed of a production mix of MB type polypropylene with a melt flow index of 600-1500 MFI (e.g. Moplen HL 508), green colour (e.g. masterbatch Remafin Green PP63076209-ZT) and the additive D; the third functional layer 3 is composed of bicomponent filaments of the core/sheath type with a diameter of 10-50 μm. Weight ratio core:sheath is found on a wide scale (e.g. 70:30). (3.1) The sheath is composed of a production mix of SB type polypropylene with a melt flow index of 10-30 MFI (e.g. Mosten NB 425), green colour (e.g. masterbatch Remafin Green PP63076210-ZT) and the additive B; (3.2) the core is composed of a production mix of SB type polypropylene with a melt flow index of 10-30 MFI (e.g. Mosten NB 425), green colour (e.g. masterbatch Remafin Green PP63076210-ZT) and a lower concentration of the additive B; produced at a production rate of 408 kg/in/hour, bonded using a raster calender; impregnated in-line with the Surfactant 2 using an inserted application kiss roller (kiss-roll) and dried on a drum dryer. The delay between the formation of the fibres and the application of the surfactant is less than 1 minute. Subsequently, the material was stored in a conditioning warehouse for a period of 5 days, where the temperature remained in the range 10-30° C. and air humidity did not fall below 60%.

EXAMPLE 5

A spunmelt type nonwoven textile composed of three functional filament layers with a total basis weight of 45 gsm, wherein the first functional layer 1 consists of continuous filaments with a diameter of 10-50 μm composed of a production mix of SB type polypropylene with a melt flow index of 10-30 MFI (e.g. Mosten NB 425), blue colour (e.g. masterbatch CC10035377BG) and the additive A; the second functional layer 2 consists of micro-filaments with a diameter of 0.5-15 μm composed of a production mix of MB type polypropylene with a melt flow index of 600-1500 MFI (e.g. Moplen HL 508) and the additive C; the third functional layer consists of filaments with a diameter of 10-50 μm composed of a production mix of SB type polypropylene with a melt flow index of 10-30 MFI (e.g. Mosten NB 425) and the additive A; produced at a production rate of 408 kg/m/hour, bonded using a raster calender. Wound up and then impregnated off-line with the Surfactant 2 using an application kiss roller (kiss-roll) and dried on a drum dryer. The delay between the formation of the fibres and the application of the surfactant was approximately 4 hours. Subsequently, the material was stored in a conditioning warehouse for a period of 5 days, where the temperature remained in the range 10-30° C. and air humidity did not fall below 60%.

EXAMPLE 6

A spunmelt type nonwoven textile composed of three functional filament layers with a total basis weight of 60 gsm, wherein the first functional layer 1 consists of continuous filaments with a diameter of 10-50 μm composed of a production mix of SB type polypropylene with a melt flow index of 10-30 MFI (e.g. Mosten NB 425), green colour (e.g. masterbatch Remafin Green PP63076210-ZT) and the additive E; the second functional layer 2 consists of micro-filaments with a diameter of 0.5-15 μm composed of a production mix of MB type polypropylene with a melt flow index of 600-1500 MFI (e.g. Moplen HL 508), green colour (e.g. masterbatch Remafin Green PP63076209-ZT) and the additive F; the third functional layer consists of filaments with a diameter of 10-50 μm composed of a production mix of SB type polypropylene with a melt flow index of 10-30 MFI (e.g. Mosten NB 425), green colour (e.g. masterbatch Remafin Green PP63076210-ZT); produced at a production rate of 408 kg/m/hour, bonded using a raster calender; impregnated in-line with the Surfactant 2 using an inserted application kiss roller (kiss-roll) and dried on a drum dryer. The delay between the formation of the fibres and the application of the surfactant was less than 1 minute. Subsequently, the material was stored in a conditioning warehouse for a period of 5 days, where the temperature remained in the range 10-30° C. and air humidity did not fall below 60%.

EXAMPLE 7

A spunmelt type nonwoven textile composed of three functional filament layers with a total basis weight of 34 gsm, wherein the first functional layer 1 is composed of continuous bicomponent filaments of the side-by-side type with a diameter of 10-50 μm. Weight ratio side:side is found on a wide scale (e.g. 60:40). (1.1) One side is composed of a production mix of SB type polypropylene with a melt flow index of 10-30 MFI (e.g. Mosten NB 425) and the additive A; (1.2) the second side is composed of a production mix of SB type polypropylene with a melt flow index of 10-30 MFI (e.g. Mosten NB 425), green colour (e.g. masterbatch Remafin Green PP63076210-ZT) and a lower concentration of the additive A; the second functional layer 2 is composed of micro-filaments with a diameter of 0.5-15 μm composed of a production mix of MB type polypropylene with a melt flow index of 600-1500 MFI (e.g. Moplen HL 508), green colour (e.g. masterbatch Remafin Green PP63076209-ZT) and the additive C; the third functional layer 3 is composed of bicomponent filaments of the side-by-side type with a diameter of 10-50 μm. Weight ratio side:side is found on a wide scale (e.g. 60:40). (1.1) One side is composed of a production mix of SB type polypropylene with a melt flow index of 10-30 MFI (e.g. Mosten NB 425) and the additive A; (1.2) the second side is composed of a production mix of SB type polypropylene with a melt flow index of 10-30 MFI (e.g. Mosten NB 425), green colour (e.g. masterbatch Remafin Green PP63076210-ZT) and a lower concentration of the additive A; produced at a production rate of 408 kg/m/hour, bonded using a raster calender; impregnated in-line with a lowered amount of the Surfactant 2 using an inserted application kiss roller (kiss-roll) and dried on a drum dryer. The delay between the formation of the fibres and the application of the surfactant is less than 1 minute. Subsequently, the material was stored in a conditioning warehouse for a period of 5 days, where the temperature remained in the range 10-30° C. and air humidity did not fall below 60%.

EXAMPLE 8

A spunmelt type nonwoven textile composed of three functional filament layers with a total basis weight of 45 gsm, wherein the first functional layer 1 consists of continuous filaments with a diameter of 10-50 μm composed of a production mix of SB type polypropylene with a melt flow index of 10-30 MFI (e.g. Mosten NB 425), blue colour (e.g. masterbatch CC10035377BG) and the additive A; the second functional layer 2 consists of micro-filaments with a diameter of 0.5-15 μm composed of a production mix of MB type polypropylene with a melt flow index of 600-1500 MFI (e.g. Moplen HL 508) and the additive C; the third functional layer 3 consists of filaments with a diameter of 10-50 μm composed of a production mix of SB type polypropylene with a melt flow index of 10-30 MFI (e.g. Mosten NB 425) and the additive A; produced at a production rate of 408 kg/m/hour, bonded using a raster calender. Wound up and then impregnated off-line with a lowered amount of the Surfactant 2 using an application kiss roller (kiss-roll), first from one side and then from the other and dried on a drum dryer. The delay between the formation of the fibres and the application of the surfactant was approximately 8 hours. Subsequently, the material was stored in a conditioning warehouse for a period of 5 days, where the temperature remained in the range 10-30° C. and air humidity did not fall below 60%.

EXAMPLE 9

A spunmelt type nonwoven textile composed of three functional filament layers with a total basis weight of 34 gsm, wherein the first functional layer 1 is composed of bicomponent filaments of the core/sheath type with a diameter of 10-50 μm. The weight ratio core:sheath is found on a wide scale (e.g. 80:20). (1.1) The sheath is composed of a production mix of SB type polypropylene with a melt flow index of 10-30 MFI (e.g. Mosten NB 425), green colour (e.g. masterbatch Remafin Green PP63076210-ZT) and the additive B; (1.2) the core is composed of a production mix of SB type polypropylene with a melt flow index of 10-30 MFI (e.g. Mosten NB 425), green colour (e.g. masterbatch Remafin Green PP63076210-ZT) and a lower concentration of the additive B; the second functional layer 2 is composed of side-by-side type bicomponent micro-filaments with a total diameter of 0.5-15 μm composed of a production mix of MB type polypropylene with a melt flow index of 600-1500 MFI (e.g. Moplen HL 508), green colour (e.g. masterbatch Remafin Green PP63076209-ZT) and the additive D, wherein the concentration of the additive and the colour varies in the individual fibre components; the third functional layer 3 is composed of bicomponent filaments of the core/sheath type with a diameter of 10-50 μm. The weight ratio core:sheath is found on a wide scale (e.g. 70:30). (3.1) The sheath is composed of a production mix of SB type polypropylene with a melt flow index of 10-30 MFI (e.g. Mosten NB 425), green colour (e.g. masterbatch Remafin Green PP63076210-ZT) and the additive B; (3.2) the core is composed of a production mix of SB type polypropylene with a melt flow index of 10-30 MFI (e.g. Mosten NB 425), green colour (e.g. masterbatch Remafin Green PP63076210-ZT) and a lower concentration of the additive B; produced at a production rate of 408 kg/m/hour, bonded using a raster calender; impregnated in-line with a lowered amount of the Surfactant 2 using an inserted application kiss roller (kiss-roll) and dried on a drum dryer. The delay between the formation of the fibres and the application of the surfactant is less than 1 minute. Subsequently, the material was stored in a conditioning warehouse for a period of 5 days, where the temperature remained in the range 10-30° C. and the air humidity did not fall below 60%.

The individual functional layers 1-3 of the nonwoven textile as described above may consist of one or more layers.

A comparative sample according to the teaching of U.S. Pat. No. 5,151,321—was treated by water solution containing 0.7% Pirefin FCN from Dr.Boehme (now Dyestar), 1.5% Synthacid FCT from Dr.Boehme (now Dyestar), 4.4% Pluvion K77 from Dr.Boehme (now Dyestar) and 4.4% Pluvioperl TEC from Dr.Boehme (now Dyestar), pH was set to 4.3 and the temperature to 20° C. The wet pick up was set to 100% and the treated fabric was exposed to 135° C. for 60 sec.

The following Table I shows an overview of properties of the material produced according to the examples and of the comparative sample.

TABLE I

| | material properties: | | | | | | | | |
|---|---|---|---|---|---|---|---|---|---|
| | Unit | | | | | | | | |
| | Basis weight | Machine direction strength | Cross direction strength | Machine direction elongation | Cross direction elongation | Water column value * | Surface resistance value** | Alcohol resistance side 1 | Alcohol resistance side 2 |
| | | Norm | | | | | | | |
| | | WSP 110.4-2005 | | | | WSP 80.6-2005 | EN 1149-1 | WSP 80.8-2005 | |
| Unit | gsm | N/50 mm | | % | | mm | Ω/m2 | degree | |
| Comparative sample | 60 | 133.1 | 54.5 | 39.8 | 47.2 | 580 | 4.9e10 | 8.0 | 8.2 |
| Example 1 | 34 | 69.8 | 39.8 | 65.1 | 70.4 | 547 | 3.1e9 | 10 | 10 |

TABLE I-continued

| material properties: | | | | | | | | | |
|---|---|---|---|---|---|---|---|---|---|
| | Unit | | | | | | | | |
| | Basis weight | Machine direction strength | Cross direction strength | Machine direction elongation | Cross direction elongation | Water column value * | Surface resistance value** | Alcohol resistance side 1 | Alcohol resistance side 2 |
| | | Norm | | | | | | | |
| | | WSP 110.4-2005 | | | | WSP 80.6-2005 | EN 1149-1 | WSP 80.8-2005 | |
| Unit | gsm | N/50 mm | | % | | mm | Ω/m2 | degree | |
| Example 2 | 45 | 85.3 | 45.2 | 59.7 | 64.7 | 612 | 4.2e9 | 10 | 9.6 |
| Example 3 | 60 | 114.9 | 50.3 | 55.3 | 59.6 | 627 | 1.3e9 | 3.5 | 4 |
| Example 4 | 34 | 70.1 | 40.2 | 69.8 | 75.2 | 555 | 2.8e9 | 9.4 | 9.8 |
| Example 5 | 45 | 84.7 | 44.7 | 60.1 | 65.3 | 590 | 3.7e9 | 10 | 9.8 |
| Example 6 | 60 | 115.1 | 50.1 | 55.2 | 60.1 | 632 | 5.3e9 | 10 | 1.2 |
| Example 7 | 34 | 69.6 | 39.9 | 64.8 | 69.9 | 549 | 2.8e11 | 9.4 | 9.8 |
| Example 8 | 45 | 85.0 | 44.8 | 59.9 | 64.6 | 589 | 5.9e11 | 9.8 | 9.6 |
| Example 9 | 34 | 79.7 | 39.9 | 65.0 | 69.8 | 599 | 9.9e10 | 9.4 | 9.6 |

TABLE II

| Properties of the selected materials before conditioning | | | | | | | | | |
|---|---|---|---|---|---|---|---|---|---|
| | Unit | | | | | | | | |
| | Basis weight | Machine direction strength | Cross direction strength | Machine direction elongation | Cross direction elongation | Water column value | Surface resistance value | Alcohol resistance side 1 | Alcohol resistance side 2 |
| | | Norm | | | | | | | |
| | | WSP 110.4-2005 | | | | WSP 80.6-2005 | EN 1149-1 | WSP 80.8-2005 | |
| Unit | gsm | N/50 mm | | % | | mm | Ω/m2 | degree | |
| Example 1 | 34 | 69.8 | 39.8 | 65.1 | 70.4 | 233 | 7.3e13 | 3.2 | 3.0 |
| Example 2 | 45 | 85.3 | 45.2 | 59.7 | 64.7 | 258 | 5.9e13 | 3.0 | 3.0 |
| Example 3 | 60 | 114.9 | 50.3 | 55.3 | 59.6 | 347 | 1.8e13 | 2.0 | 2.2 |
| Example 4 | 34 | 70.1 | 40.2 | 69.8 | 75.2 | 245 | 6.2e13 | 2.6 | 2.8 |
| Example 5 | 45 | 84.7 | 44.7 | 60.1 | 65.3 | 289 | 5.5e13 | 2.8 | 2.8 |
| Example 6 | 60 | 115.1 | 50.1 | 55.2 | 60.1 | 331 | 9.8e12 | 3.2 | 1.4 |
| Example 7 | 34 | 69.6 | 39.9 | 64.8 | 69.9 | 238 | 7.9e13 | 3.4 | 3.2 |
| Example 8 | 45 | 85.0 | 44.8 | 59.9 | 64.6 | 274 | 7.3e13 | 3.0 | 3.0 |
| Example 9 | 34 | 79.7 | 39.9 | 65.0 | 69.8 | 232 | 8.1e13 | 3.2 | 3.2 |

* The water pressure 60 mbar

** The value of the surface resistance was measured on the side where the conditioner was applied.

INDUSTRIAL APPLICABILITY OF THE INVENTION

The solution according to the invention can be used for manufacturing SMS type nonwoven textiles, or of other combinations of individual layers containing at least one SB component and/or MB component, using an equipment for a so called under the nozzle production of nonwoven textiles (spunmelt technology). The nonwoven textile is intended especially for manufacturing protective garments and further aids to be used in industry as well in health care, however the use is not limited to said fields.

The invention claimed is:

1. A method of producing nonwoven textile, the method comprising:

i) providing a production mix of polymer, the basis of which is a polyolefin polymer suitable for forming fibres;

ii) providing a first additive capable of increasing a barrier surface property and capable of migration through the polymer;

iii) mixing said polymers and said first additive;

iv) forming fibres from said mix and a nonwoven textile from said fibres;

v) providing a second additive capable of modifying an antistatic surface property and capable of adhering to a surface of said fibres;

vi) applying said second additive to the surface of the fibres of said nonwoven textile; and vii) establishing temperature and relative humidity conditions for a time period such that said second additive undergoes changes to thereby increase said antistatic surface property on said surface and said first additive migrates towards said surface;

wherein said changes of the second additive take place at least partly prior to the first additive completing its migration to the surface and establishing a final barrier surface property.

2. The method according to claim 1, wherein the second additive is applied in the form of a solution.

3. The method according to claim 2, wherein the second additive is applied in the form of a water solution.

4. The method according to claim 1, wherein the first additive is selected from a group consisting of compounds comprising fluorocarbon, wax and silicon groups.

5. The method according to claim 1, wherein the second additive is selected from a group comprising carboxylic groups or their salts, sulphate groups, alkylsulphates or alkylglykoethersulphates, sulphonates, alkylsulphonates, alkylbenzen sulphonates, alkylphosphates, alkylphenylphosphates, alkylaminsalts, quaternary ammonium salts, alkylpyridine salts and alkylaminocarboxylic acids.

6. The method according to claim 1, wherein said polyolefin polymer suitable for forming fibres is a mixture of thermoplastic polymers, comprising at least 70% by weight of a thermoplastic polyolefin.

7. The method according to claim 6, wherein the polyolefin is a polypropylene.

8. The method according to claim 6, wherein the polyolefin comprises copolymers.

9. The method according to claim 8, wherein the polyolefin comprises copolymers of a polypropylene.

10. The method according to claim 8, wherein the polyolefin comprises copolymers of a polyethylene.

11. The method according to claim 1, wherein said fibres are bicomponent fibres.

12. The method according to claim 1, wherein said migration of the first additive towards the surface of the fibres and the changes of the second additive on the surface of the fibres take place under a temperature of at least 10° C. and a relative humidity of at least 25%.

13. The method according to claim 1 wherein said migration of the first additive towards the surface of the fibres and the changes of the second additive on the surface of the fibres take place for at least 5 hours.

14. The method according to claim 1, wherein said fibres comprise the first additive, while the second additive, which is applied to the surface of the fibres, is bonded to the surface by covalent bonds, by cross-linking, by ionic, Van der Waals, or hydrogen bonds, or by adhesive forces.

15. The method according to claim 1, wherein the method is continuous.

16. The method according to claim 1, wherein the method is discontinuous and comprises a delay between the production of the fibres comprising the first additive and the application of the second additive, the delay being less than 12 hours.

17. The method according to claim 1, wherein the nonwoven textile as produced exhibits a surface resistance (according to the EN 1149-1) of less than $5\times10e12\ \Omega/m^2$, and an alcohol repellency expressed by the level of drop test (according to the WSP 80.8-2005) is over 3.

18. The method according to claim 1, wherein the nonwoven textile as produced exhibits a water penetration repellency as expressed by the value of the water column value (according to WSP 80.6-2005) which is reduced by less than 50% when compared to a comparative nonwoven textile produced under the same conditions but without adding said first additives and said second additive and their interaction.

19. A method of production of a multi-layer nonwoven textile comprising at least one first layer of the nonwoven textile comprising first fibres with a diameter of 10-50 μm and at least one second layer of the nonwoven textile comprising second fibres with a diameter of 0.5-15 μm wherein at least one of said first and second layers is produced by the method of claim 1.

20. A method of production of a multi-layer nonwoven textile according to claim 19, wherein the fibres having a diameter of 0.5-15 μm represents at least 10 weight % of the total weight of the multi-layer nonwoven textile.

* * * * *